US007389907B2

(12) United States Patent
Smith

(10) Patent No.: US 7,389,907 B2
(45) Date of Patent: Jun. 24, 2008

(54) TRI-FOLD BLISTER CARD WITH OPENING MECHANISM

(75) Inventor: Jeffrey A. Smith, Medford, NJ (US)

(73) Assignee: Weyerhaeuser Company, Federal Way, WA (US)

( * ) Notice: Subject to any disclaimer, the term of this patent is extended or adjusted under 35 U.S.C. 154(b) by 78 days.

(21) Appl. No.: 11/296,737

(22) Filed: Dec. 7, 2005

(65) Prior Publication Data

US 2007/0125679 A1 Jun. 7, 2007

(51) Int. Cl.
*B65D 65/26* (2006.01)
*B65D 65/16* (2006.01)
*B65D 73/00* (2006.01)

(52) U.S. Cl. ..... 229/87.05; 206/462; 206/469; 206/777; 229/87.06

(58) Field of Classification Search ..... 206/461–471, 206/769–774, 775–783; 229/71–72, 84, 229/87.06, 92.8, 87.05, 103.2, 307, 309, 229/310
See application file for complete search history.

(56) References Cited

U.S. PATENT DOCUMENTS 2,673,680 A * 3/1954 Deutschmeister et al. ..... 229/71
3,036,705 A * 5/1962 Haecker ..... 206/462
3,151,741 A * 10/1964 Haecker ..... 206/462
3,352,415 A * 11/1967 Seeley et al. ..... 206/465
3,476,239 A * 11/1969 Jacob ..... 206/461
3,946,508 A * 3/1976 Booras ..... 229/71
4,506,789 A * 3/1985 Dlugosz ..... 206/469
4,824,143 A * 4/1989 Grainger ..... 206/462
4,890,872 A * 1/1990 Parrotta et al. ..... 206/581
5,088,617 A * 2/1992 Williams et al. ..... 229/87.05
6,230,964 B1 * 5/2001 Saito ..... 229/92.8

* cited by examiner

*Primary Examiner*—Bryon P Gehman

(57) ABSTRACT

The present invention includes a unique tri-fold blister card and resulting tri-fold blister card package for packing, shipping and displaying a product at a point-of-purchase. The tri-fold blank improves the visual impact of the product package by providing a printable area in the reveal area of the tri-fold blister card. The tri-fold design allows for single surface printing at little or no additional cost. The tri-fold blister card preferably includes features that allow a consumer to more easily open the tri-fold blister car package. These easy opening features include pre-defined glue patterns and an opening mechanism that is easy to operate. Further, the tri-fold blister card package can include a handle that preferably provides for easier handling by a consumer without distracting from the visual impact of the package.

4 Claims, 9 Drawing Sheets

TRI-FOLD BLISTER CARD WITH OPENING MECHANISM

FIELD OF THE INVENTION

This invention relates generally to blister packaging for the shipment, storage, and display of a product. More specifically, the present invention relates to a tri-fold blister card.

BACKGROUND

Blister packaging is used by many marketing and manufacturing companies for the shipment, storage, and display of product or products. Blister packages combine a high perceived product value with a relatively low cost packaging proposition. These blister packages typically include a clear plastic blister that houses the product and allows the product to be visible to the consumer and a card that covers the open end of the blister. The card can be formed from paperboard or similar flat sheet stock material.

The front of the card typically includes a printable area that is used for identification and marketing presentation of the product. The marketing presentation can take the form of graphics or other artwork. But the reveal area behind the blister is not a printable area and hence does not include any marketing presentation.

Bi-fold cards are also known and used. Conventional bi-fold cards typically include an inside liner that has a non-printable area and an outside liner that has a printable area. When the card is folded over, the printable area is on the front and back of the card and the reveal area behind the blister includes the non-printable area of the inside liner. It is desirable to improve the visual impact of the blister card package.

It is also known to use specific materials, to add materials, and to include strengthening features to the design of the blister card in an attempt to strengthen the card and avoid bending or folding of the blister card. It is desirable to improve the strength of the blister card.

Blister cards are sealed closed to prevent tampering and theft and as a result can be difficult to open in order to remove the product stored within the blister. In this regard, it is known to provide a door on the back of the card in order to facilitate removal of the product. Blister cards that are tamper/theft resistant yet easy for a consumer to open are desired. It is also desired to provide features to improve handling of the blister card package.

SUMMARY

[to be completed once claims are finalized]

Additional features and advantages of the invention will be made apparent from the following detailed description of illustrative embodiments that proceeds with reference to the accompanying drawings.

BRIEF DESCRIPTION OF THE DRAWINGS

The invention is best understood from the following detailed description when read in connection with the accompanying drawing. It is emphasized that, according to common practice, various features of the drawings are not to scale. On the contrary, the dimensions of various features are arbitrarily expanded or reduced for clarity. Included in the drawings are the following Figures.

DETAILED DESCRIPTION OF ILLUSTRATIVE EMBODIMENTS

Figure 1:
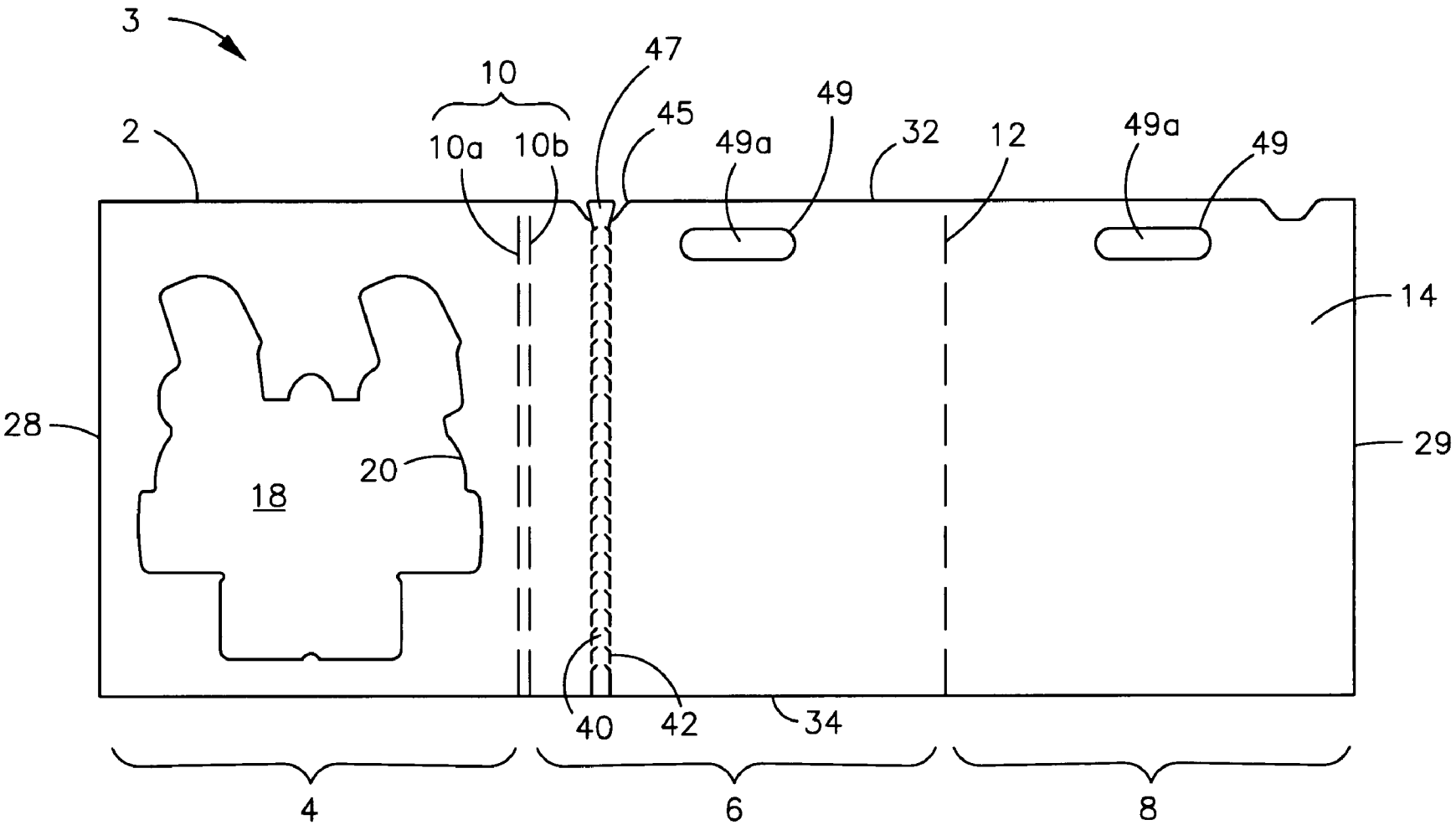
FIG. 1 is an inside view of an exemplary tri-fold blister card.

The present invention includes a tri-fold blister card that provides an improved visual impact of the product package. The tri-fold blister card package includes a reveal area that has a printable area that can be used as part of the marketing billboard. Graphics can be applied behind the product thus improving the visual appeal of the blister package. The printable area in the reveal area behind the blister also provides for more options and greater creativity on the part of artwork developers and marketing personnel. The tri-fold card design provides for the application of graphics on a single face of the card and allows for printing of the entire surface with little of no additional costs.

The graphics can include artwork of a decorative, instructional, cautionary, and/or marketing nature. The printable area and graphics can be used as billboard for artwork and other indicia. For example, the graphics can serve to identify the product and/or product manufacturer, provide instructions and/or warnings, be used as an advertising billboard during transit, storage, and display at point of purchase, etc.

The tri-fold blister card is also designed and constructed to allow for easy opening of the blister card package by a consumer. A consumer opens the blister card in order to remove the product stored in the blister card package. One aspect of the easy opening design includes the use of an opening mechanism located on the back of the blister card. The opening mechanism allows for easy opening of the blister card without compromising graphics. Another feature that facilitates an easy opening design includes the use of a closure system having pre-defined glue landing areas that allows the front panel of the tri-fold blister card to be opened easily once the opening mechanism is activated to gain access to the product. The closure system and opening mechanism provide the security of a tamper-proof and theft resistant package.

The tri-fold blister card can also include features for improved handling of the blister card package as a nicety to the consumer. For example, the tri-fold blister card includes a handle that may by used by consumers to provide a secure grip to remove the blister card package from a display and for carrying the blister card package during shopping. In an embodiment, the handle is designed and constructed so that the handle does not distract from the visual impact of graphics.

In an embodiment, the tri-fold blister card is constructed from materials that provides a sturdy and strong design, and that allows the tri-fold blister card package to be mounted in slotted holding trays that may be stacked during shipment, storage, and display without bending or buckling of the card. One material for the construction of the blister card is containerboard, and more preferably, corrugated board. The slotted trays are constructed to allow multiple trays to be stacked one on top of another on, for example, a pallet, while still providing views of the product from the sides.

FIG. 1 shows an exemplary blank 2 of the tri-fold blister card 3. As shown in FIG. 1, the blank 2 includes a first panel 4, a second panel 6, and a third panel 8. A first score 10 separates the first panel 4 from the second panel 6. As shown in FIG. 1, the first score 10 includes a double score 10*a*, 10*b* that facilitates the folding of the first panel over the width of the combined second and third panels 6, 8. A second score 12 separates the second panel 6 and the third panel 8.

The blank 2 includes an inside surface or liner 14 and an outside surface or liner 16. FIG. 1 shows an inside view of the blank 2, meaning that the inside liner 14 of the blank 2 is up and shown. The outside liner 16 is on the underside of the blank 2 (and hence not visible in FIG. 1).

In one embodiment, the inside liner 14 includes a paper material and the outside liner 16 includes a printable material. The entire outside liner 16 comprises a printable material suitable for receiving graphics. The type of printable material will depend, at least in part, on the printing process that will be employed to print the graphics on the outside liner 16 of the blank 2. For example, in an embodiment wherein a litho laminator will be used to apply the graphics, the printable material includes a litho-label material.

The blank 2 includes one or more cut-out(s) 18 defining cut-out window(s) 20 in the first panel 4. The size and shape of the cut-outs 18 will depend on the product that will be contained in the tri-fold blister card package 1. For example, the cut-out can include a single cut-out for each individual product, a single cut-out for a plurality of products, or any combination of cut-out(s)/product(s) as desired.

The blank 2 is preferably formed of a single piece of material. The blank 2 includes a formable material cut and scored to form the blank 2 that is then combined with a blister 50 to form a container (i.e., the assembled tri-fold blister card package 1) for holding a product 60. In an embodiment, the blank 2 is constructed from at least one of: paperboard, containerboard, corrugated board, linerboard, singleface, and the like.

In the illustrated embodiment, the third panel 8 is constructed to fold over the second panel 6, and the first panel 4 is constructed to fold over the folded third panel 8. As such, in the assembled configuration, the second panel 6 forms the back of the tri-fold blister card 3, the first panel 4 forms the front of the tri-fold blister card 3, and the third panel 8 forms an intermediate panel having a printable reveal area which is visible through the cut-out in the first panel 4.

Figure 2:
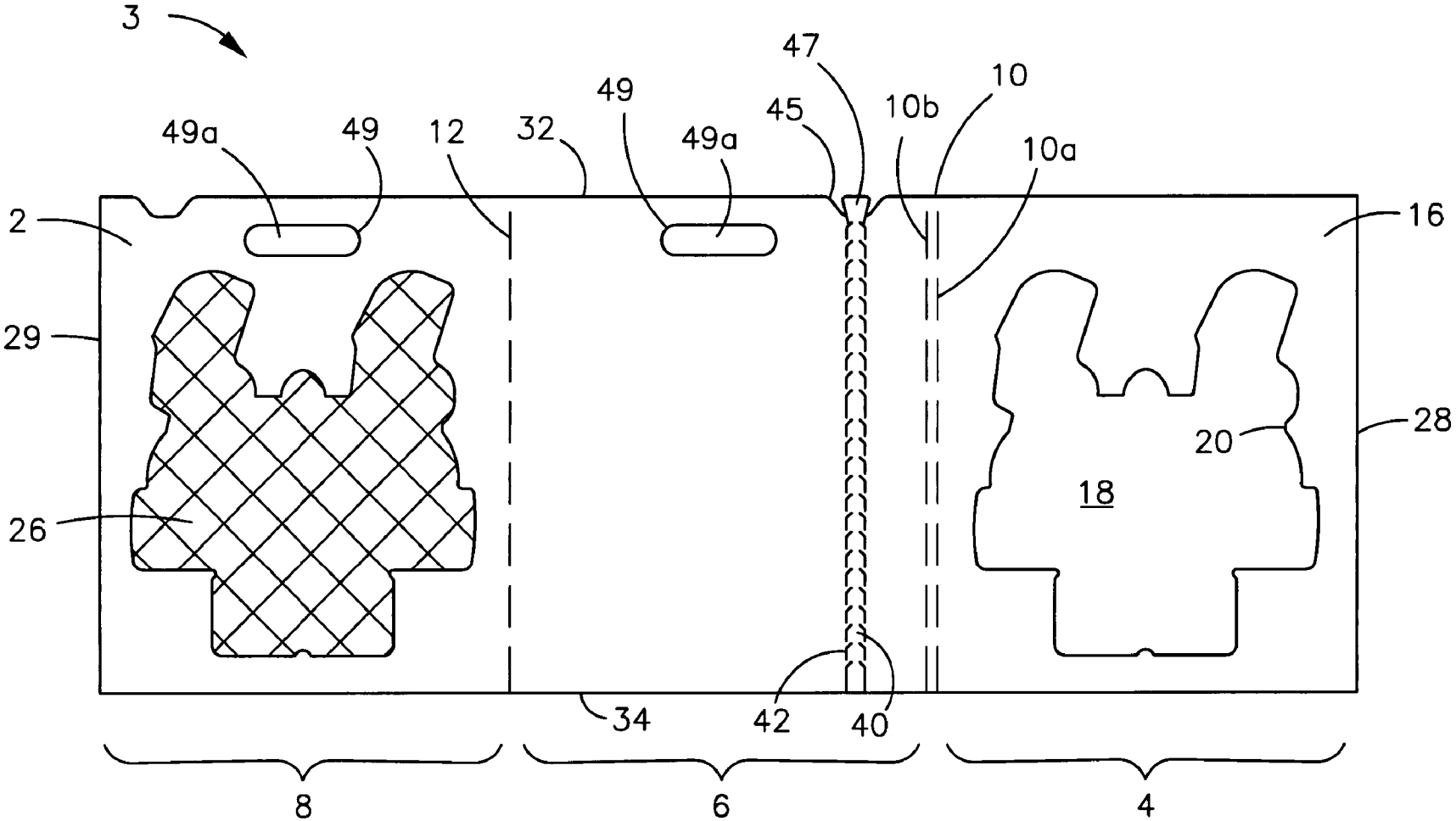
FIG. 2 is an outside view of the exemplary tri-fold blister card of FIG. 1 showing an exemplary printable reveal area.

FIG. 2 shows an outside view of the blank 2 showing a reveal area 26 on the third panel 8. In one embodiment, at least the reveal area 26 on the outside liner 16 of the third panel 8 comprises a printable area. As shown in FIG. 2, the reveal area 26 can be sized and shaped to match the cut-out window 20 in the first panel, such that when the blank 2 is folded the reveal area 26 covers the area visible through the cut-out window 20 (see cross-hashing area in FIG. 2). Alternatively, the entire outside liner 16 of the third panel 8 can include a printable material, such that when the blank 2 is folded the entire area visible through the cut-out window 20 includes a printable area (see cross-hashing area in FIG. 4).

The tri-fold blister card 3 can be folded and closed using a variety of closure means. In one embodiment, only the first panel 4 is connected to the third panel 8 proximate the open or free end 28 of the first panel 4. In this embodiment, the second panel 6 and the third panel 8 do not have to secured to one another since the second panel 6 is connect at each end to the first and third panels, 4, 8, respectively, and the third panel 8 forms the intermediate panel, and the free end 29 of the third panel 8 is therefore secured when the first panel 4 is secured to the third panel 8. In an alternate embodiment, described more fully below, a portion of the third panel 8 may be connected to a portion of the second panel 6 when the third panel 8 is folded over the second panel 6, and the first panel 4 may also be connected to the third panel 8, when the first panel 4 is folded over the folded third panel 8.

Figure 3:
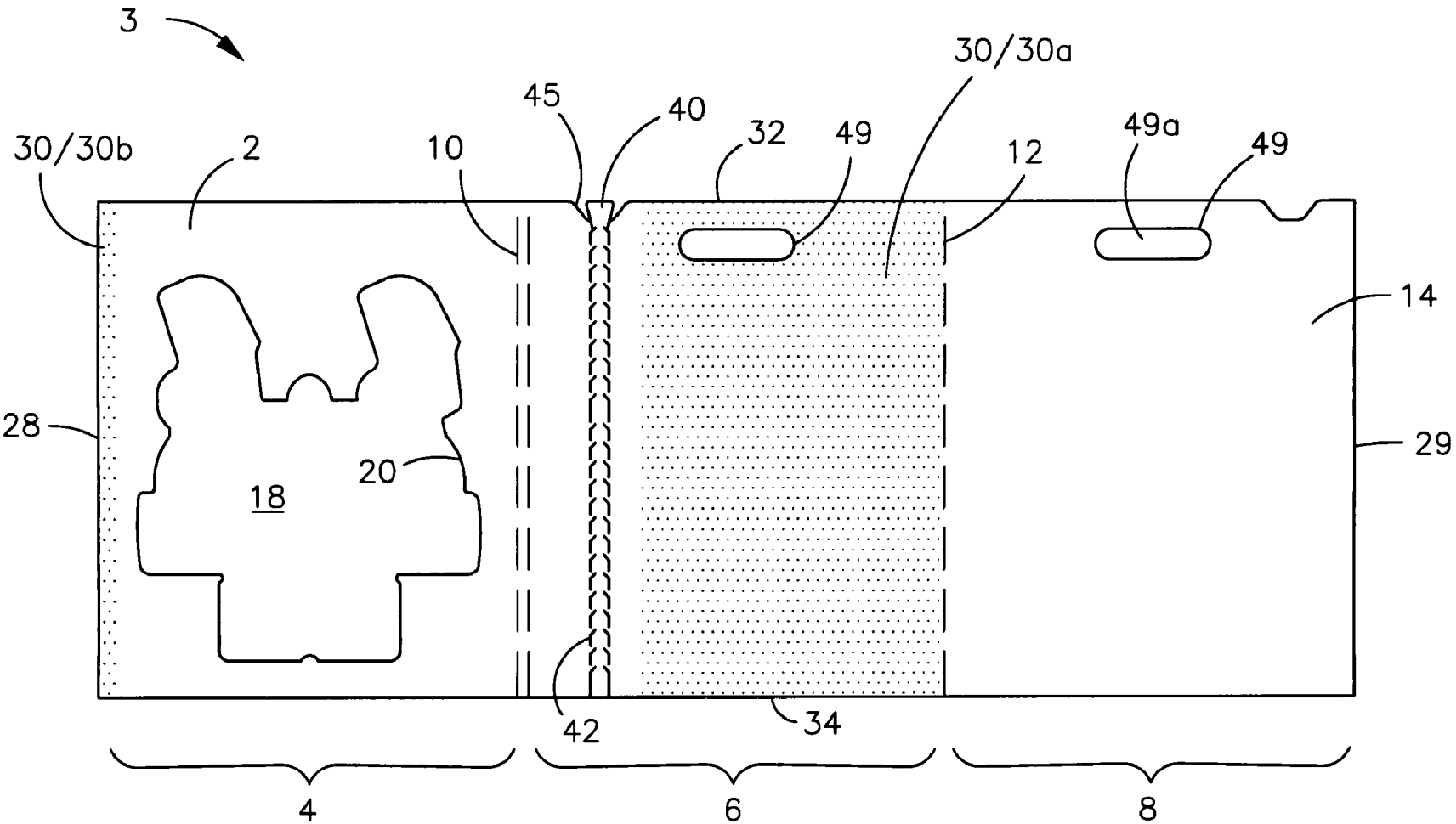
FIG. 3 is an exemplary tri-fold blister card showing exemplary glue landing areas for assembling the blister card.

FIG. 3 illustrates an exemplary glue landing area 30 illustrating one embodiment of connecting the three panels together. In one embodiment, the closure system includes the use of pre-defined glue landing areas that allows the front panel 4 of the tri-fold blister card 3 to be opened easily to gain access to the product 60. A first glue landing area 30*a* can be provided between the second and third panels 6, 8. As shown, the first glue landing area 30*a* can include any of the area from a top edge 32 to a bottom edge 34 of the blank 2 between the opening mechanism 40 and the second score 12. A second glue area 30*b* can be provided between the first and third panels 4, 8. As shown, the second glue landing area 30*b* can include an area from a top edge 32 to a bottom edge 34 of the blank 2 between the free end 28 of the first panel 4 and the cut-out window 20.

Figure 4:
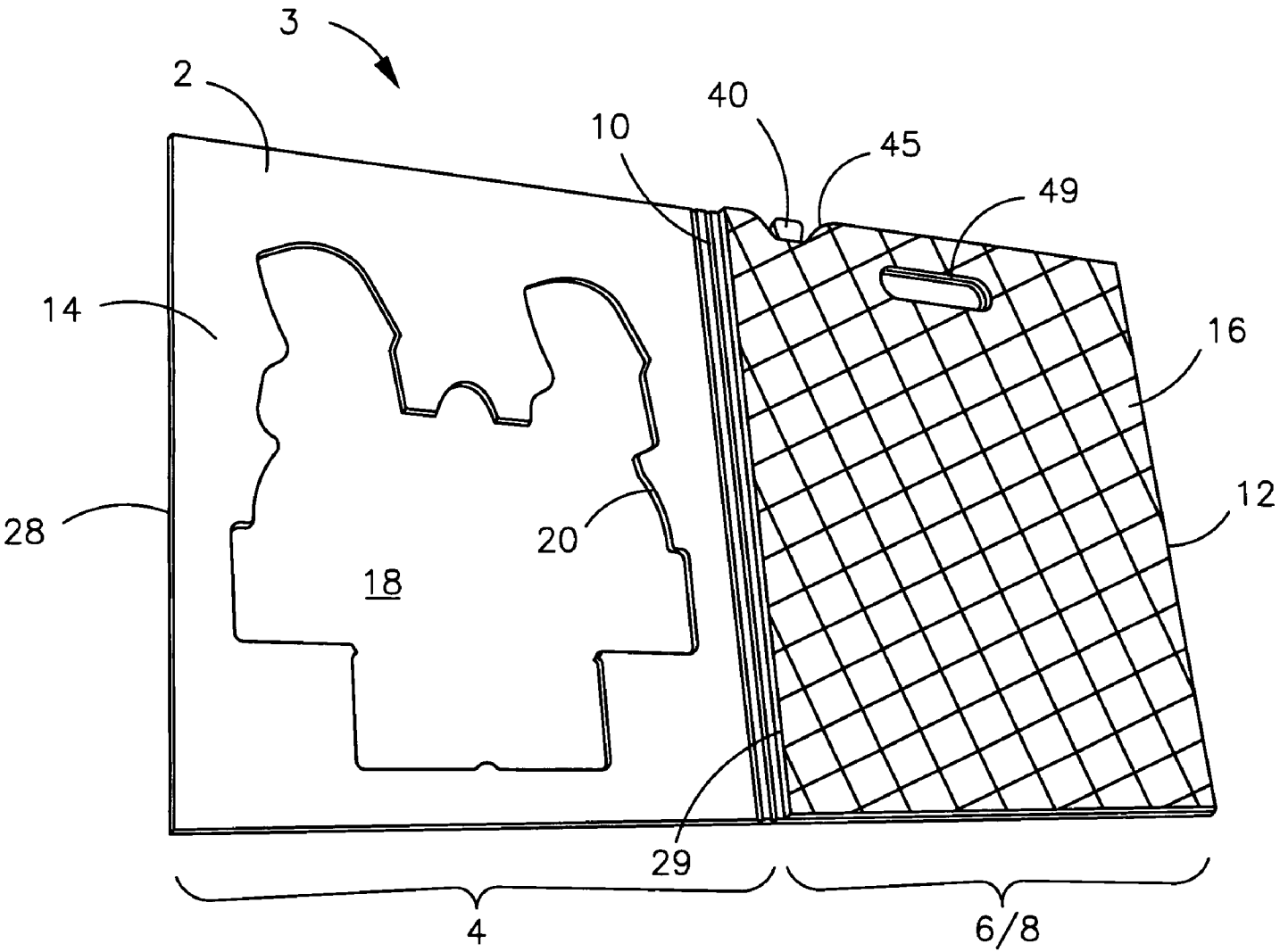
FIG. 4 illustrates the exemplary tri-fold blister card of FIG. 1 having the third panel folded over the second panel.

In one embodiment, the blank 2 can be manufactured and the third panel 8 can be folded over and glued to the second panel 6, see for example, FIG. 4. The partial assembled blank can then be shipped to a manufacturer of the product to be contained within the tri-fold blister card package 1. The product manufacturer would then insert the blister through the cut-out window 20 in the first panel 4, insert the product in the blister, fold and glue the first panel 4 over the third panel (combination of the previously folded second and third panel 6, 8). This would complete the assembly of the tri-fold blister card package 1. Instructions can be provided to the product manufacturer showing the recommended glue landing area to facilitate easy opening of the tri-fold blister card package 1.

Figure 5A:
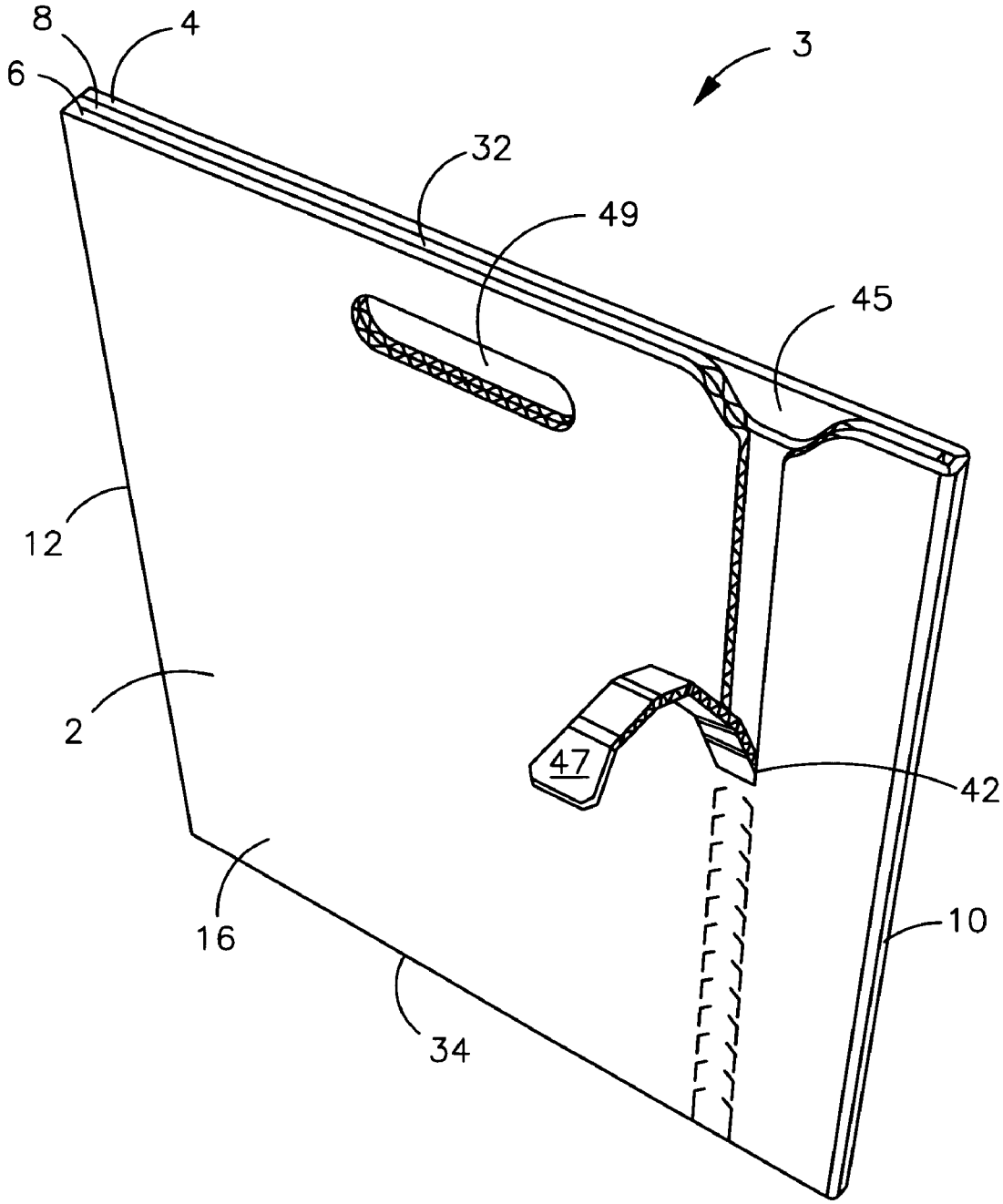
FIGS. 5A-5C illustrates an exemplary opening mechanism for allowing a consumer to open the tri-fold blister card easily.

As shown in FIGS. 1 and 5A, the tri-fold blister card 3 is may include an opening mechanism 40 to allow for easy opening of the tri-fold blister card package 1 by a consumer. In an embodiment, the opening mechanism 40 is located so as to minimize interference with graphics. In this regard, the opening mechanism is located on the back of the blister card 3, which in the illustrated embodiment is the second panel 6. As shown, the opening mechanism 40 can include a perforated pull tab 40 that extends from the top edge 32 to the bottom edge 34 of the blank 2.

Figure 5B:
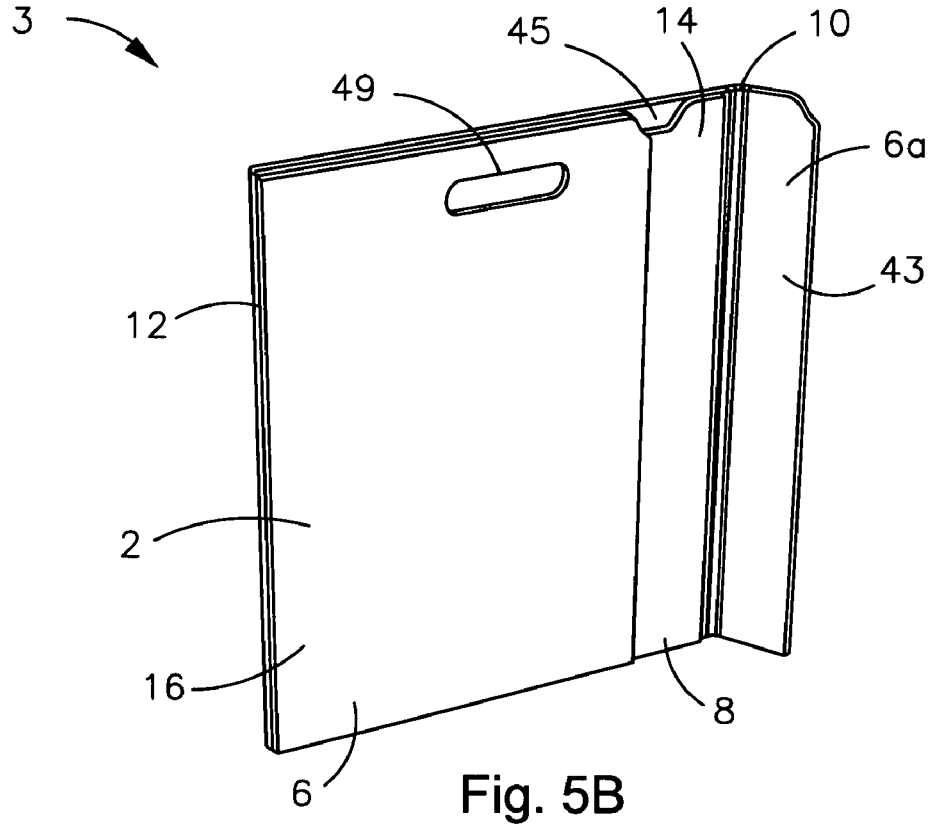
Figure 5C:
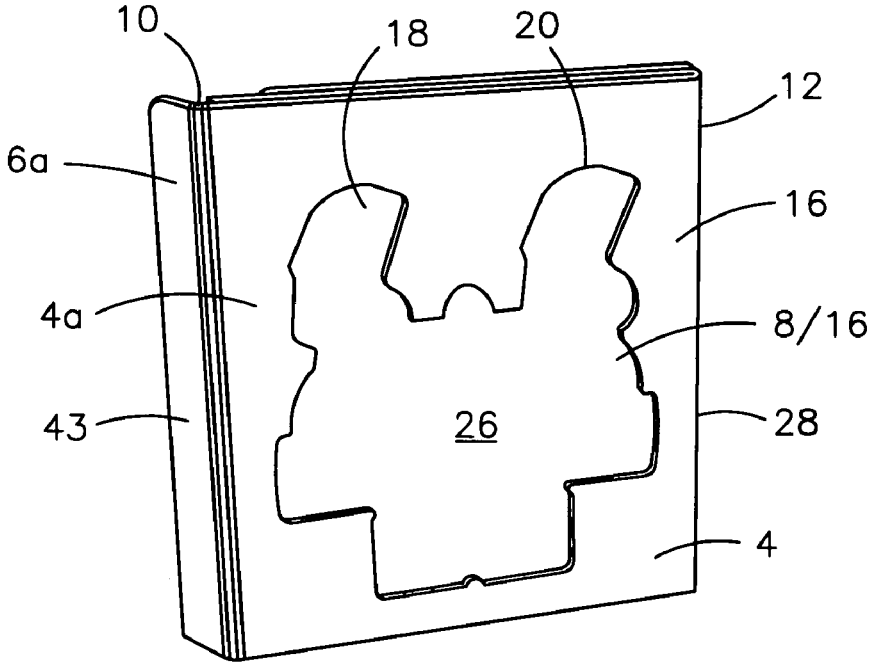

In operation of the illustrated pull tab or zipper embodiment, an operator grasps and pulls the zipper 40 outward and downward, thereby separating the second panel 6 along the perforation 42 (see FIG. 5A showing zipper 40 partially open). In an embodiment, the portion of the second panel 6*a* between the perforation 42 and the first panel 4 is not secured to the third (intermediate) panel 8 and is free to open (see FIG. 5B showing the freed portion 6*a* of the second panel 6 in an open position). This portion 6*a* of the second panel forms an opening flap 43 that the operator can grasps to open the tri-fold blister package 1. Likewise, at least a portion 4*a* of the first panel connected to the freed portion 6*a* of the second panel 6 is also preferably not secured to the third (intermediate) panel 8 and is free to open (see FIG. 5C). In this manner, the consumer can easily get to and remove the product.

As shown in Figures, a notched region 45 can be formed in the blank 2. The notched region 45 facilitates the operation of the opening mechanism 40. In one embodiment, the notched region 45 can be formed in at least said third panel. Alternatively, the notched region 45 can be formed in the third panel 8 and the second panel 6, or in all three panels 8, 6, 4. It is preferred that the notched region 45 be constructed so as not to distract from the graphics. In the pull tab embodiment shown, the notch region 45 is formed in the third and second panels 8, 6. The notched region 45 provides access to the tab 47 of the pull tab 40 (or top of the zipper) when said tri-fold blister card 3 is in said assembled configuration (see, for example, FIG. 5A).

The opening mechanism can include other devices, such as tear tape (not shown) having a first end for starting the tape. For a tear tape embodiment, the operator grasps one end of the tear tape and pulls outward and upwards, thereby stepping through the blank material and separating the second panel.

As shown in the figures, the blank 2 preferably a handle 49 that provides improved handling of the blister card package 1 as a nicety to the consumer. In one embodiment, the handle 49 is located so that it does not distract from the visual impact of graphics. By way of non-limiting example only, the handle 49 is located in at least the third panel 8, although it may be located in the second and third panels 6, 8, or thorough all three panels. As shown, for example, in FIGS. 1, 4, and 5A, the handle 49 may include a cut-out 49*a*in the blank 2. As shown, the handle cut-out 49*a* is in the third and second panels 8, 6. The handle 49 may by used by consumers to provide a secure grip to remove the blister card package 1 from a display and for carrying the blister card package 1 during shopping. The handle may take other forms, such as a push-in or pop-out handle (not shown). During use, the operator pushes the push-in inward or alternatively, pulls the pop-out handle outward and then grasps the handle.

Figure 6A:
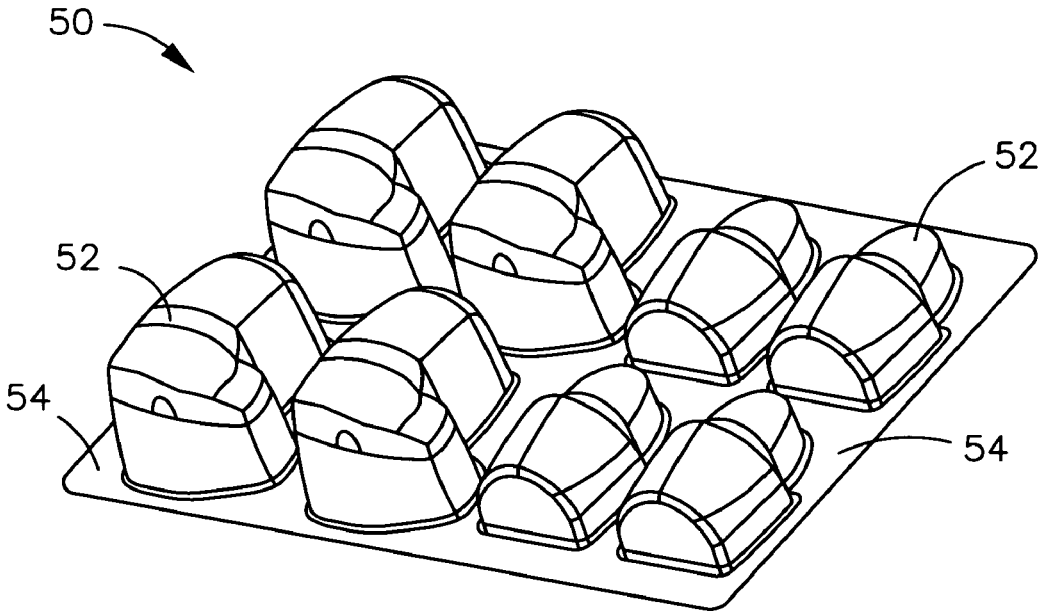
FIGS. 6A-6B illustrates exemplary blister that can be used with the tri-fold blister card.
Figure 6B:
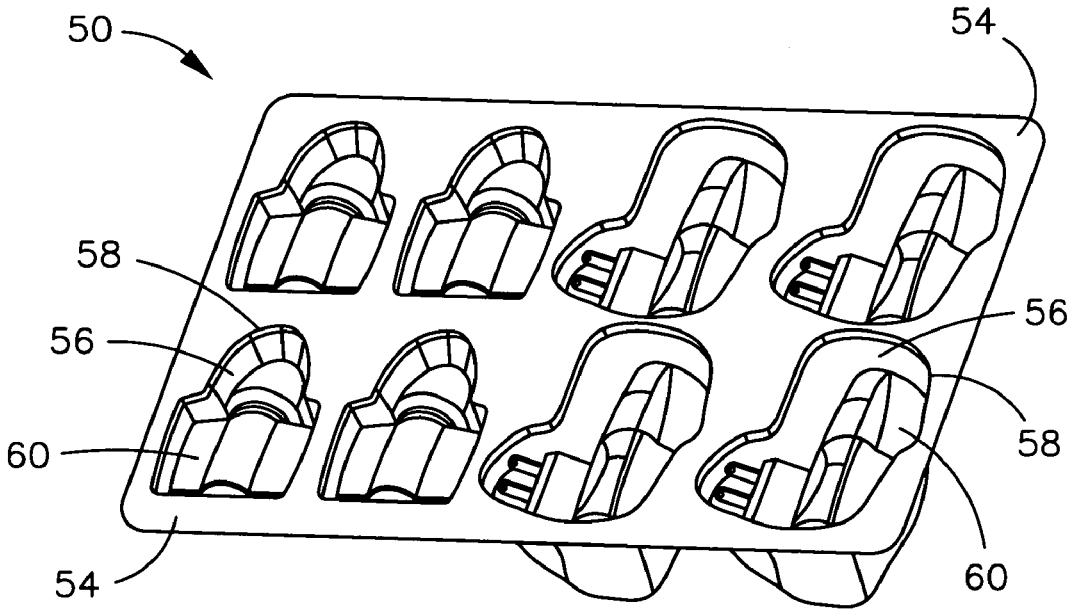

FIGS. 6A and 6B show an exemplary blister 50. FIG. 6A shows the front of the blister 50 and includes raised portions 52 that extend from a flange 54. FIG. 6B shows the back of the blister 50 and includes cavities 56 having open ends 58 for receiving product 60.

The size and shape of the blister 50 as well as whether an individual blister or multiple blisters are employed can vary and may depend on several factors, including factors relating to the particular product that will be contained in the tri-fold blister card package 1. For example, the blister 50 can include a single blister for each individual product, a single blister with a plurality of product cavities, or any combination of blister(s)/product(s) as desired. In an embodiment, the cavities 56 are designed and constructed to hold the particular product 60 that will be contained therein and the walls of the cavities 56 are in close proximity or touching the product 60 to securely contain the product and protect it during shipping, storage, and display.

The assembled tri-fold blister card package 1 includes at least two components, the blister 50, which houses the product 60, and the card 3, which closes and supports the blister 50. In the exemplary assembled tri-fold blister card packages 1 shown in FIGS. 7A and 7B, the blister 50 extends through the cut-out window 20 in the first panel 4. The blank 2 closes the open end 58 of said blister 50 to enclose and contain the product 60 within the blister 50. In an embodiment, the blister 50 is constructed from a substantially transparent (i.e., clear) plastic material that allows a product 60 contained within the cavity 56 of the blister 50 to be viewed from an exterior of the blister 50.

In an embodiment where corrugated board material is used to form the blank 2, the medium, or flutes, (not shown) of the corrugated board is preferably oriented vertically from a top edge 32 of the blank 2 to a bottom edge 34 of the blank 2. This construction improves the strength of the blank 2 in the vertical direction and facilitates standing of the tri-fold blister card package 1 in a holding tray and also facilitates stacking of one or more holding trays one on top of another.

Figure 7A:
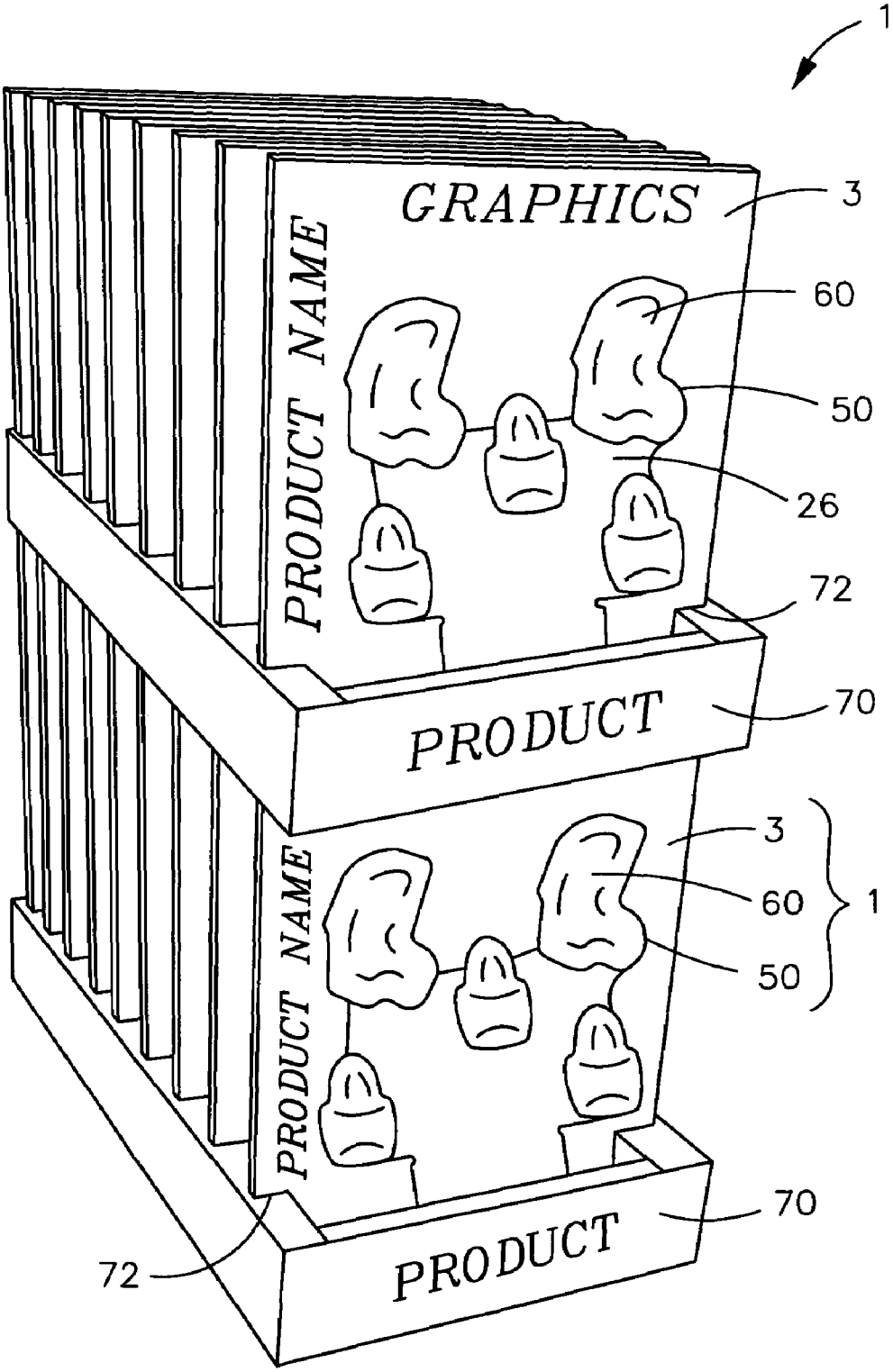
FIG. 7A shows a perspective view of a plurality of assembled tri-fold blister card packages containing a product fitted in exemplary slotted holding trays for shipping and display of the product.

FIG. 7A shows a plurality of assembled tri-fold blister card package 1 in a holding tray 70. The hold tray 70 may include slots 72 for receiving and holding the tri-fold blister card package 1. In an embodiment, the sides of the hold tray are short relative to the height of the tri-fold blister card package 1, thereby allowing the product to be viewed while held in the holding tray 70. The holding tray 70 facilitates shipping, storage and display of the tri-fold blister card package 1.

Figure 7B:
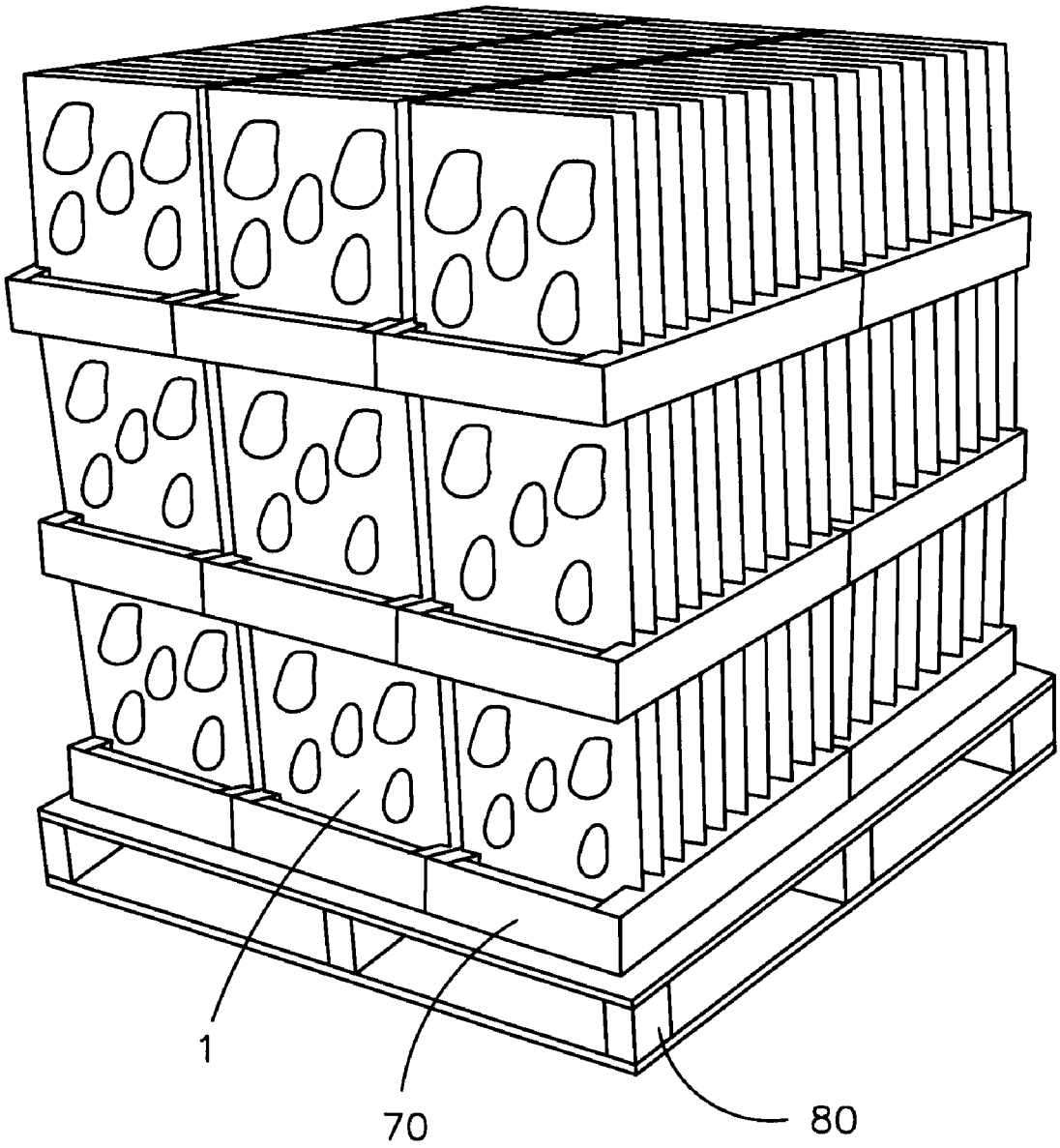
FIG. 7B shows a plurality of holding trays housing assembled tri-fold blister card packages stacked on a pallet for shipping and display of the product.

FIG. 7B illustrates trays 70 each holding a plurality of tri-fold blister card packages 1, wherein the holding trays 70 are arranged in a stacked configuration on a pallet 80. This facilitates shipping, storage, and display of the product contained within the tri-fold blister card packages 1 during sale at, for example, a wholesale club.

Although the invention has been described with reference to exemplary embodiments, it is not limited thereto. Rather, the appended claims should be construed to include other variants and embodiments of the invention, which may be made by those skilled in the art without departing from the true spirit and scope of the present invention.

What is claimed:

1. A tri-fold blister card comprising:

a blank in an assembled configuration and defining an inside surface and an outside surface of the tri-fold blister card;

a first panel having one or more cut-out windows, wherein said first panel comprises a front of said tri-fold blister card;

a second panel extending from said first panel, wherein said second panel comprises a back of said tri-fold blister card;

a first score interconnecting and separating said first panel and said second panel;

a third panel extending from said second panel, wherein said third panel comprises an intermediate panel located between said first panel and said second panel, wherein said third panel comprises a reveal area that is visible through said one or more cut-out windows in said first panel;

a second score interconnecting and separating said second panel and said third panel; and, further comprising an opening mechanism in said second panel for opening said tri-fold blister card wherein said opening mechanism further comprises a perforated pull tab defined by a perforation that extends from the top edge to the bottom edge of the second panel, wherein activation of said pull tab causes said second panel to separate along said perforation.

2. The tri-fold blister card of claim 1, wherein said outside surface further comprises an outside liner, wherein said outside liner comprises a printable material.

3. The tri-fold blister card of claim 2, wherein graphics are applied to said printable material of said outside liner.

4. The tri-fold blister card of claim 1, further comprising an opening flap that results from said opening mechanism being activated, wherein said opening flap is formed by a portion of said second panel extending between said perforation and said first panel after said second panel is separated by activation of said opening mechanism, wherein said opening flap can be gasped by an operator to open at least a portion of said first panel.

* * * * *